US005095734A

United States Patent [19]

Asher

[11] Patent Number: 5,095,734

[45] Date of Patent: Mar. 17, 1992

[54] EXTRUSION DIE AND METHOD FOR EXTRUDING ALUMINUM

[75] Inventor: David M. Asher, Newnan, Ga.

[73] Assignee: William L. Bonnell Company, Inc., Newnan, Ga.

[21] Appl. No.: 627,712

[22] Filed: Dec. 14, 1990

[51] Int. Cl.[5] ..... B21C 25/02

[52] U.S. Cl. ..... 72/467; 72/260

[58] Field of Search ..... 72/467, 260, 253.1, 72/377

[56] References Cited

U.S. PATENT DOCUMENTS

| | | | |
|---|---|---|---|
| 1,789,675 | 1/1931 | Elias | 72/377 |
| 2,341,749 | 2/1944 | Webb | 72/467 |
| 2,671,559 | 3/1954 | Rosenkranz | 72/467 |
| 2,698,684 | 1/1955 | Guiney | 72/467 |
| 2,894,623 | 7/1959 | Walton | 72/467 |
| 2,968,835 | 1/1961 | Weston | 72/467 |
| 4,436,975 | 3/1984 | Nomura et al. | 219/69 W |
| 4,467,166 | 8/1984 | Gamo et al. | 219/69 W |
| 4,703,146 | 10/1987 | Kinoshita | 219/69 W |
| 4,803,328 | 2/1989 | Obara | 219/69 W |
| 4,806,720 | 2/1989 | Obara | 219/69 W |
| 4,862,728 | 9/1989 | Hardouin | 72/467 |

FOREIGN PATENT DOCUMENTS 902885 2/1982 U.S.S.R. ..... 72/253.1

OTHER PUBLICATIONS

Pp. 7 and 9 of brochure of Fanuc Ltd., Minamitsuru, Japan.

Article "Die Design and Construction in Europe", Alan Castle, Roger Flory and John Gagg, pp. 25-34 of the report of proceeding of the 1988 AEC Meeting.

Article "Extrusion Die Making in the United States", Luis E. Bello, pp. 45-52 of the preceedings of the 1988 AEC Meeting.

*Primary Examiner*—Daniel C. Crane

*Attorney, Agent, or Firm*—Emch, Schaffer, Schaub & Porcello

[57] ABSTRACT

An extrusion die for extrusion of metal has a passageway with a bearing section having parallel bearing surface portions in the direction of extrusion which extend inwardly from an inlet opening a variable distance based upon the size of the gap at such portions and a relief section downstream from said bearing section and having relief surface portions tapering away from said bearing surface portions in the direction of extrusion, said relief surface portions following a straight-line path.

16 Claims, 4 Drawing Sheets

EXTRUSION DIE AND METHOD FOR EXTRUDING ALUMINUM

The present invention relates to extrusion dies, particularly to ones which are ideally suited for extruding aluminum, magnesium and alloys thereof and to a method of precisely forming such dies more economically and reliably than heretofore known.

BACKGROUND OF THE INVENTION

Dies used in the manufacture of extruded metal parts such as ones formed from aluminum, magnesium or similar metals are subjected to extremely high forces and, therefore, must be designed with sufficient strength to withstand such forces without excessive distortion or cracking. Additionally, such dies must be capable of consistently forming the extruded part to accurate dimensional tolerances, preferably within the range of 0.003 to 0.010 inches in any cross-sectional dimension.

The prior art discloses a number of extrusion dies and methods for forming. For example, U.S. Pat. No. 4,862,728 discloses an extrusion die which is negatively tapered essentially throughout its length at an angle of at least 1° such that any friction stress between the die lands and metal flowing through them is negligible. This patent describes certain advantages which it purports to have over conventional extrusion dies such as that shown and described in FIG. 1 thereof. The foregoing patent, including the problems with respect to the prior art extrusion dies, is incorporated herein by reference and a copy of such patent is enclosed herewith.

With respect to the extrusion die and method of forming disclosed in U.S. Pat. No. 4,862,728, its design provides that a sharp corner function as its bearing surface which determines the cross-sectional configuration of the extruded part and that a short tapered section or die land 20 generally ". . . not more than about 2 mm" extend downstream from said corner bearing surface. (See column 2, lines 54 and 55). The die downstream of such tapered die land 20 has an aperture defined by a cambered depression 22 which can result in a potential flexing or distortion when material is extruded therethrough due to insufficient support of the cantilevered section forming the die land 20. (See specifically the lack of support outwardly of the corner 24). Additionally, since the length of the die aperture intended to determine the cross-sectional configuration of the extruded article is zero, there is a question of whether it is sufficient to equalize the flow of the metal.

SUMMARY OF THE INVENTION

The present invention is based upon a number of design characteristics deemed desirable which can be achieved utilizing the forming method of the present invention. Thus, the present invention begins with the premise that for many complex cross-sectional configurations it is desirable to have a die with a bearing surface having a length falling within a range proportional to the gap or thickness of metal being extruded through any given section and of providing relief surfaces downstream of the bearing surface which are tapered outwardly within a specified range of angles but without limit with respect to its length in order to provide whatever strength is required to support the portion of the die defining the bearing surface. In order to provide a relief surface of sufficient length to insure that the die has whatever strength is required to support the portion defining the bearing surface, the size and configuration of the opening at the outlet side of the die is determined. In determining the size and configuration of such opening, it must be recognized that such opening does not determine the size or configuration of the article to be extruded and that such opening is always larger and spaced from all portions of the article being extruded as the size and configuration of the article is determined by the size and configuration of the bearing surface. The importance of determining the size and configuration of the opening on the outlet side can be appreciated by considering a die for manufacturing a U-shaped section and recognizing that the relief surfaces in that portion of the die forming the inside surfaces of the two legs of the "U" (i.e., the tongue of the die) will taper toward each other. It is important that each of such portions of those relief surfaces extend as far as possible, preferably completely to the outlet side of the die. It is desirable that they not intersect one another before reaching such outlet side as to do so would be to provide a smaller amount of support structure than would otherwise be available and, thus, a die weaker in that area than if the relief surfaces extended completely to such outlet side. However, for complex shapes having U-shaped sections with a narrow gap between the legs, the relief surfaces may intersect each other before reaching the outlet side. Even in these situations, the die is far superior to dies of the prior art.

The method disclosed and claimed herein for forming such die permits it to be accurately formed with a fixed size and configuration of bearing surface disposed parallel to the axis of extrusion and with variations in the length of the bearing surface based upon the thickness of the gap (and hence thickness of the extruded article) at any given point throughout the cross section while shaping the relief surface to a configuration and size of opening at the outlet side which insures sufficient strength for all portions of the die, even those having complex shapes with a long tongue. The length of the bearing surface in relation to the thickness of the gap at any given point for complex sections may be in the range of 0.8:1.0 and 1:1. For simple sections the ratio could be smaller such that the length of the bearing surface could approach zero in certain areas and can be greater in areas having a configuration which provides a reduced frictional drag on the part being extruded.

The method for forming such dies according to the present invention is believed to be unique and provides for economical and accurate manufacture.

Accordingly, it is an object of the present invention to provide a new and novel extrusion die for extruding metals such as aluminum, magnesium and alloys thereof, as well as similar types of metals which are capable of extrusion.

It is a further object of the present invention to provide a method for forming an extrusion die which is precisely contoured with configurations not heretofore possible with prior art methods of forming. For example, with prior art extrusion dies, if the article being extruded had a U-shaped configuration, there was a fairly restrictive limit on the length of the tongue (i.e., length of the legs) in relation to its width (i.e., gap between the legs). Thus, in the prior art dies problems are encountered if the length of the tongue exceeds the width by about a 4:1 ratio ("tongue ratio") as there is insufficient strength to support the cantilevered end of the tongue from the loads to which it is subjected during extrusion. In contrast, dies of the present invention manufactured according to the process disclosed herein are capable of producing U-shaped articles having tongue ratios in excess of 15:1.

The extrusion die of the present invention includes a passageway extending from an inlet side to an opposite outlet side, said passageway communicating with an inlet aperture formed in a planar face of said inlet side. The passageway has a bearing section with bearing surfaces extending inwardly from the planar face along a path parallel to the direction of extrusion and perpendicular to the planar face of the inlet side. The length of the bearing surfaces are longer in portions defining thicker sections of extruded product and shorter in areas defining thinner sections. Downstream from the bearing section is a relief section having surfaces tapering outwardly at an angle of at least ¼° to ½° and up to as much as about 25°. Using the method of manufacture disclosed and claimed herein, the tapered relief section in any given area around the periphery of the outlet of the bearing surface extends along a straight line path from the such outlet of the bearing surface, preferably completely to the outlet side of the die. This is a significant factor in providing great structural strength of the die.

The method of making the extrusion die utilizes wire-cut electrical discharge machining having four-axis capability and includes the steps of determining the desired size and shape of the bearing surface, the length of the bearing surface, and therefore the exit end thereof, at various areas around the periphery and the size and shape of the opening at the intersection of the relief surface wiht the outlet side of the die. After determining the foregoing either through the use of a computer or otherwise, the metal block or blank from which the die is to be formed is cut with the first of two passes with a wire of an electric discharge wire cutting machine with the first cut performed using a four-axis machine. Wire-cut electrical discharge machining including four-axis taper cutting is well-known in the art as shown in U.S. Pat. Nos. 4,467,166 and 4,806,720 (copies enclosed) which are incorporated herein by reference. In a four-axis electric discharge wire cutting machine, a cutting wire is supported on an upper fulcrum moveable in both X and Y directions in a first plane and a lower fulcrum moveable in both X and Y directions in a second plane independently of the upper fulcrum and extends along a straight line between such fulcrums. In the first pass, the upper and lower fulcrums are caused to move in paths, respectively, such that the wire will form an opening on the outlet side of the workpiece which corresponds to the desired size and shape at the intersection of the relief surface with such outlet side and tapering inwardly from the outlet side toward the inlet side such that the wire will intersect those portions of the workpiece intended to define the exit end of the bearing surface. As will be appreciated, such movement will cause the wire to form an aperture at the inlet surface of the blank having a configuration similar to but smaller than the desired configuration of such bearing surface. Thus, that portion of the blank above the desired exit end of the bearing surface and inwardly from such bearing surface form what may be considered an extension between the newly formed aperture at the inlet surface and the desired aperture inlet defined by the bearing surface to be subsequently formed. In the second pass the extension is removed by moving a cutting wire parallel to the direction of extrusion to form said bearing surface.

The die of the present invention is particularly well-suited for the production of extruded articles having complex cross-sectional configurations, particularly one having long tongues and ones in which some areas are thicker than other areas. It is based upon the concept of providing a bearing surface which is only long enough to equalize the flow through the die of the metal being extruded coupled with providing a tapered relief area of whatever length is necessary for support of the bearing section. It has been found that excellent results can be achieved by providing a bearing length in any given portion or area of the die equal to between 0.8–1.0 times the width of the die gap in that area. The width of the die gap for any given area is substantially the same as the thickness of the extruded part in that area. For very simple sections, such as one having a circular or rectangular cross-sectional configuration, the above ratio could be smaller with the length of the bearing surface approaching zero in certain areas as set forth in the above referenced U.S. Pat. No. 4,826,728. The die constructed according to the present invention permits extrusion of complex shapes with lower friction and, therefore, cooler temperatures and increased die life than extrusion dies used heretofore. For example, the die of the present invention will permit complex aluminum shapes to be extruded at temperatures on the order of 40°–60° F. cooler than similar dies heretofore used in extruding such complex shapes. The design of the die of the present invention permits it to withstand the great pressures developed in forcing the aluminum material therethrough with the result that such die has greater die life than previous dies and require fewer repairs. It has reduced cost of manufacture, shorter lead time to produce and improved reliability. The method of producing such die is such that the geometry of the relief surface can be defined to any level of detail down to 0.005 inches radius. This is particularly useful in forming relief surfaces for complex shapes to insure that the relief surface extends completely to the outlet surface of the die and has a sufficient degree of taper.

IN THE DRAWINGS

DETAILED DESCRIPTION OF THE INVENTION

Figure 1:
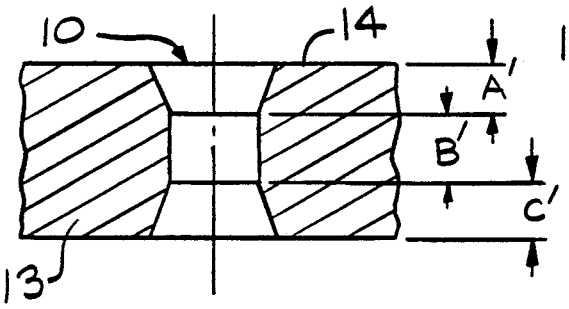
FIG. 1 PRIOR ART
FIGS. 1–3 are sections through prior art extrusion dies.

FIG. 1 illustrates prior art as described in U.S. Pat. No. 4,862,728 and includes a die plate 13 having an upstream face 14 and a downstream face 16 with an aperture formed in the die plate 13 having an initial choked section A' extending to the upstream face 14, an intermediate section B' where the die lands on opposite sides of the aperture are substantially parallel and a final opening section C' extending to the downstream face 16. For extrusion, metal is forced through the die in the direction shown by the arrow 10.

Figure 2:
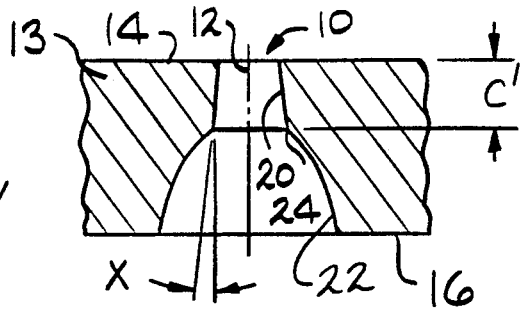
FIG. 2 PRIOR ART

Referring now to FIG. 2, there is illustrated the extrusion die setting forth the invention of U.S. Pat. No. 4,862,728. FIG. 2 shows a die plate 13 having an upstream face 14 and a downstream face 16. An aperture has an axis 12 perpendicular to the upstream face 14 of the plate 13. For extrusion, metal is forced through the die in the direction shown by the arrow 10.

The entrance of the die is defined by a substantially sharp corner 18 which is as sharp as possible, having a radius of curvature of less than 0.2 mm. According to the patent, if the corner is much blunter than this, there is increased frictional drag and the advantages of such die are lost.

The die land 20 is shown as having a negative taper of X degrees with the minimum value of X being about 0.8°–1.0° with no critical maximum value but generally something less than 25°. The length C' of the die land 20 is stated to be sufficiently short that fouling does not significantly take place thereon during extrusion. The maximum permissible value of C' may increase as the angle X increases so that when the angle X is 1°, C. should generally be not more than about 2 mm but that when angle X is 10°, C. may be as long as 18 mm.

On the downstream side, the aperture is defined by a cambered depression 22 which connects with the downstream end die lands at a corner 24.

Figure 3:
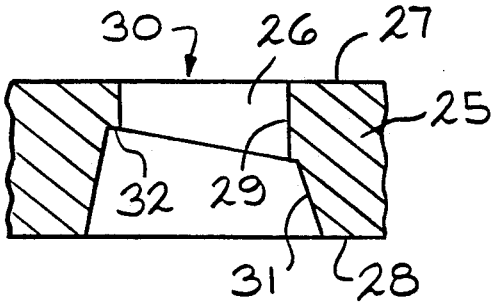
FIG. 3 PRIOR ART

FIG. 3 shows a conventional prior art extrusion die 25 having a passageway 26 extending from an upstream or inlet side 27 to a downstream or outlet side 28. The passageway 26 is defined by a bearing surface 29 which is parallel to the direction of extrusion 30 and a relief surface 31 disposed at an angle which tapers outwardly in the direction of extrusion. The extrusion die 25 is formed by milling and includes a step 32 joining the bearing surface 29 to the relief surface 31.

The bearing surface 29, in addition to being parallel to the direction of extrusion, is shown as having a varying length. The purpose of the varying length is to having a longer bearing surface in those areas of the die used to form thicker sections and shorter lengths of bearing surface in those portions of the die used to form thinner portions.

Figure 4:
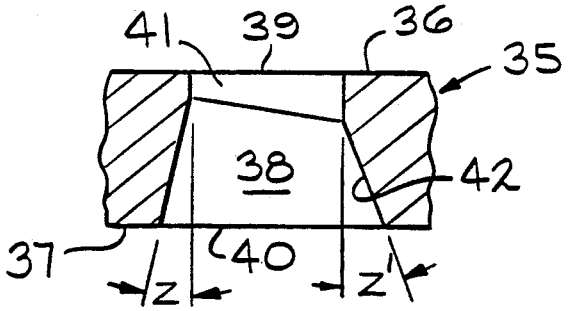
FIG. 4 is a section through an extrusion die formed according to the present invention.
Figure 5:
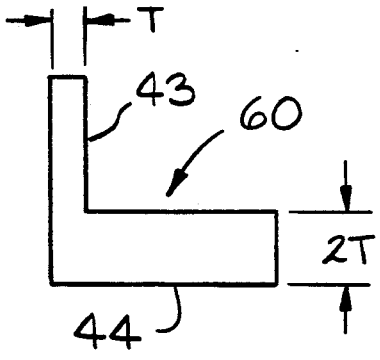
FIG. 5 is a plan view of one shape of extruded article which may be formed using the die of the present invention.
Figure 6:
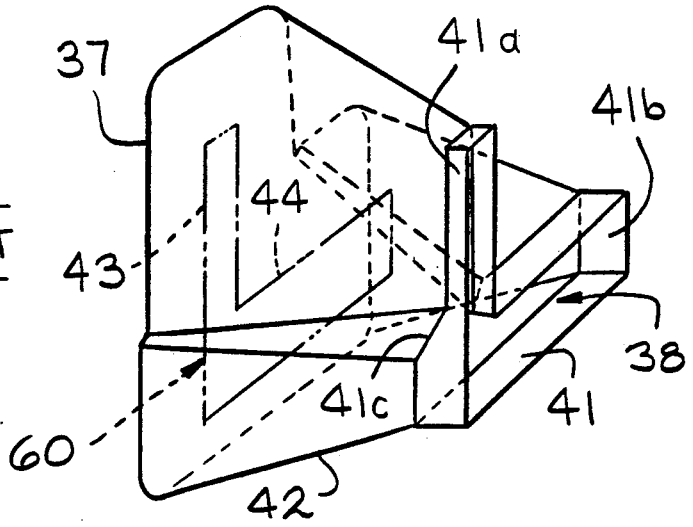
FIG. 6 is a perspective view showing schematically the shape of the bearing surfaces and relief surfaces of a die manufactured according to the present invention for extruding an article having the shape of FIG. 5.

Referring now to FIGS. 4–6, the die of the present invention, generally designated by the numeral 35 has a planar inlet face 36, a planar outlet face 37 parallel to the inlet face 36 and a passageway 38 extending therethrough. The passageway 38 extends from an inlet aperture 39 on the inlet face 36 to an aperture 40 at the outlet face 37. The passageway 38 includes a bearing surface 41 all portions of which are parallel to one another in the direction of extrusion and perpendicular to the planar inlet face 36. Extending downstream from the bearing surface 41 and flaring outwardly along a straight-line path is a relief surface 42. The relief surface 42 has a negative taper of Z degrees as shown in FIG. 4 which should be at least ¼° to ½° with no fixed maximum. The angle of taper of the relief surface 42 may be different in various portions of the die as illustrated by the angle Z' which is greater than the angle Z. It is not expected that the relief surface 42 would be disposed at an angle greater than about 25°.

As shown in FIG. 4, the length of the bearing surface 41 may vary and is generally proportional to the width of the gap in any particular area of the die. For example, in FIG. 5 there is illustrated an extruded article 60 suitable for manufacture with the die 35. The extruded article 60 has a vertical leg 43 and a horizontal leg 44 integral therewith. The thickness of the leg 43 is represented by the letter T while the thickness of the horizontal leg 44, which is approximately twice as thick, is represented by the designation 2T.

FIG. 6 is a schematic representation showing the passageway 38 portions defined by the portions of the bearing surface 41 and the portions of the relief surface 42 for extrusion of the part 60 shown in FIG. 5. Thus, as shown in FIG. 6, the portion of the bearing surface 41 forming the leg 43 which has a thickness of T is relatively short and is illustrated by the numeral **41*a* while the portion of the bearing surface 41 forming the thicker leg 44, which has a thickness of 2T, is longer and is designated by the numeral 41*b*. For example, the length of the bearing surface portion 41*a* will be on the order of 0.8T to 1.0T while the length of the bearing surface portion 41*b* will be on the order of 1.6T to 2.0T. As will be appreciated there is a transition area or transition bearing surface 41*c* of varying length joining the bearing surface portion 41*a* with the bearing surface portion 41*b*. Preferably, all portions of the relief surface 42 extend completely to the outlet face 37 of the die. However, as previously mention, for complex shapes such as ones having U-shaped sections with a narrow gap between the legs, portions of the relief surface 42 intersect other portions before reaching the outlet face 37. As can be seen from FIG. 6, the angle of taper of some areas of the relief surface 42 will be different than the angle of taper of other areas of such relief surface 42. For example the area of the relief surface 42 extending from the short bearing surface portion 41*a* will be disposed at an angle different from the angle of the area of the relief surface 42 extending from the longer bearing surface portion 41*b* and the areas extending from the transition area 41*c* may have still different angles. The difference in angle of taper can also be seen in FIG. 4 where the relief surface portion 42 shown on the right side of passageway 38 is greater than the relief surface portion shown on the left. Also shown in phantom lines in FIG. 6 is an outline of part 60 and the position of its legs 43 and 44 in relation to the relief surface 42**.

Figure 7:
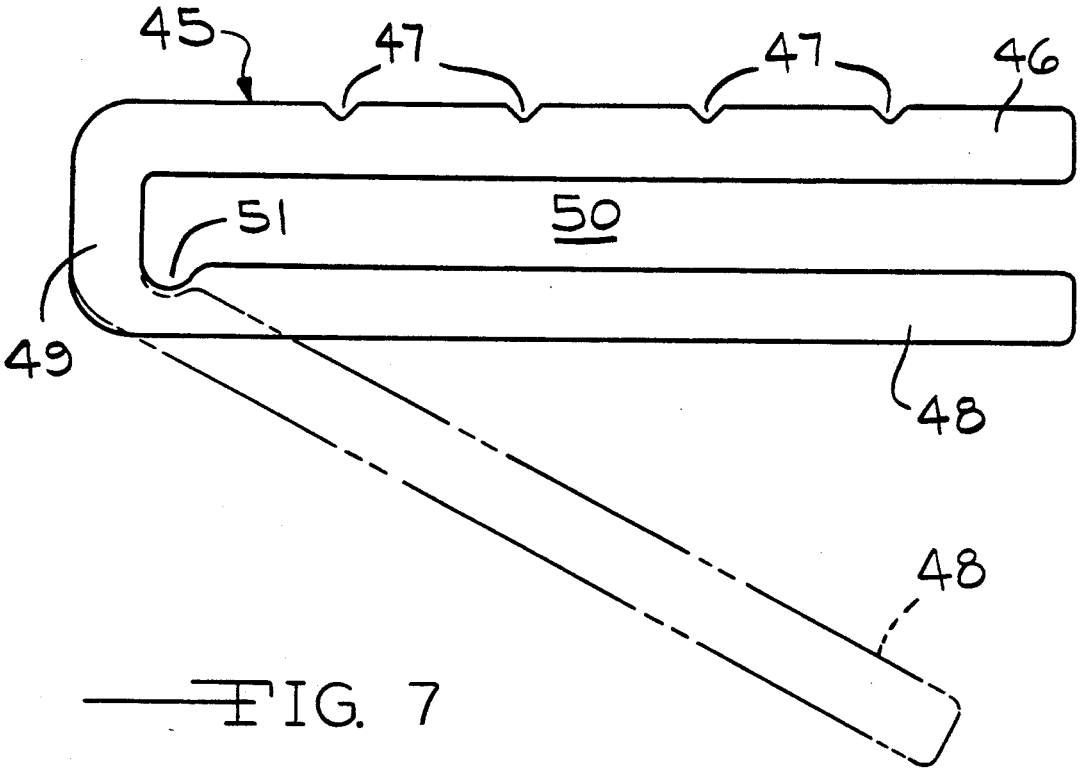
FIG. 7 is a plan view of a U-shaped article having legs which are long in relation to the space therebetween with dotted lines illustrating how such article is produced using prior art extrusion dies.
Figure 8:
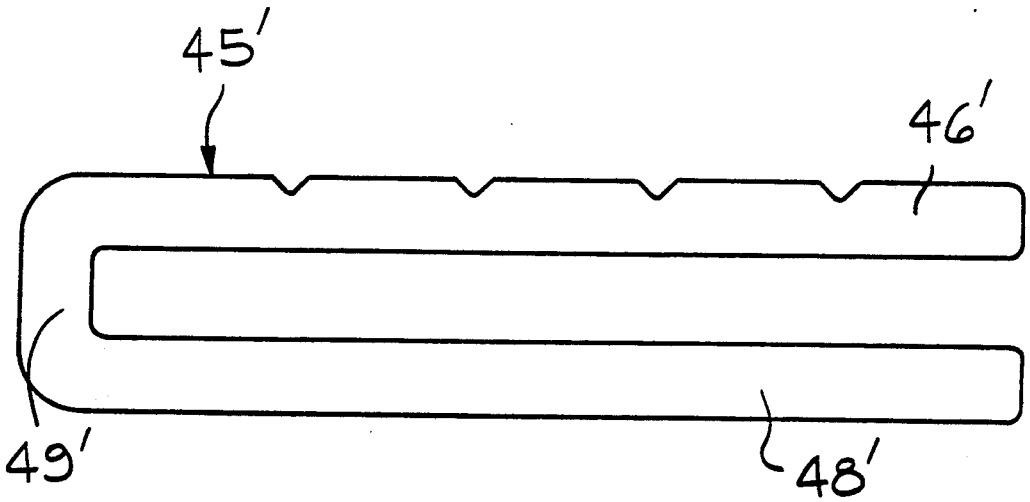
FIG. 8 is a plan view of an article having a configuration similar to that of the U-shaped article of FIG. 7 which is extruded to final shape using a die of the present invention.

Referring now to FIGS. 7 and 8, there is illustrated a U-shaped article having a tongue ratio greater than 4:1 and illustrating the two-step process required to manufacture such article according to the prior art in contrast to its manufacture using the die of the present invention which permits it to be extruded in its final desired configuration.

FIG. 7 shows in full lines a U-shaped extrudate 45 having a first leg 46 with a series of scallops 47 or grooves and a second leg 48 which is parallel thereto in spaced apart relationship. The first leg 46 is joined to the second leg 48 by an end leg 49. As can be seen, the lengths of the first and second legs 46 and 48 are long in relationship to the space 50 between the inner surfaces of the first leg 46 and second leg 48. For example, the space between the legs in this particular part is 0.060 inch while the overall length of the part is 0.688 inch from the outer surface of the end leg 49 to the ends of the first and second legs 46 and 48, respectively. The thickness of the end leg 49 and of the first and second legs 46 and 48 is 0.050 inch. Accordingly, the length of the U from the interior surface of the end leg 49 to the ends of the first and second legs 46 and 48 is 0.638 inch. Thus, as will be appreciated, the space 50 between the respective first leg 46, second leg 48 and end leg 49 is more than ten times as long as its width. As will be appreciated, in order to directly extrude a part having such configuration, it is would be required to have a die with a tongue conforming in shape to that of the space 50. As previously discussed, it has heretofore not been possible to extrude parts with dies having tongue portions in which the length of the tongue was more than about four or five times the breadth of the tongue because the forces of extrusion acting upon the long and unsupported tongue were greater than the tongue could withstand without undue distortion and/or failure. Accordingly, it was necessary to extrude such types of extrudates as those shown at 45 with one of the legs, the second leg 48 as illustrated in FIG. 7, at a substantial angle, on the order of 35°, to the first leg 46 and then, in a subsequent rolling operation reshape the second leg 48 to the desired position shown in full lines in FIG. 8 with the second leg 48 parallel to the first leg 46. In order to minimize the resistance encountered in any such reshaping operation, the extrudate 45 was typically formed with an area of reduced thickness as shown at 51 in FIG. 7.

In FIG. 8, there is shown as extrudate 45' having a first leg 46', a parallel spaced apart second leg 48' and an end leg 49' and having a similar U-shaped configuration and size as that of FIG. 7 which may be directly extruded to such configuration using the extrusion die of the present invention. As can be seen, it is not necessary to provide an area of reduced thickness similar to the reduced thickness area 51 of the extrudate 45 of FIG. 7 since it is not necessary to reform the extrudate 45'.

Figure 9:
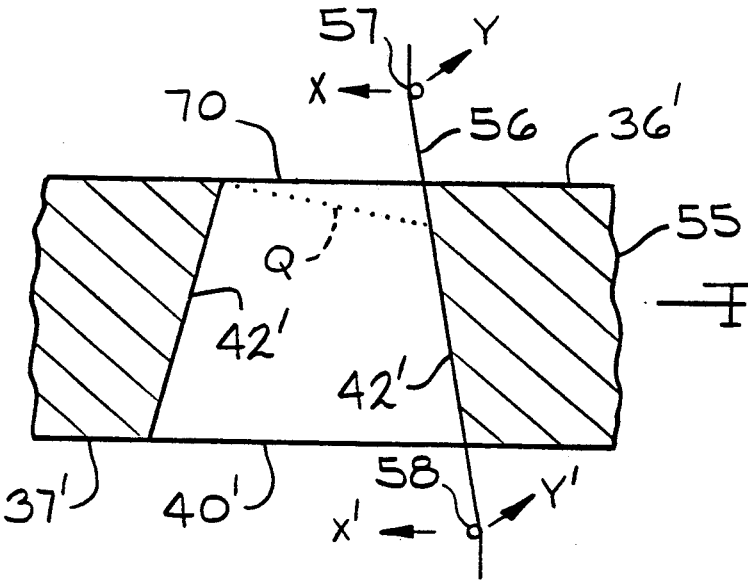
FIGS. 9–11 are schematic views illustrating the method of the present invention used for forming such dies.
Figure 10:
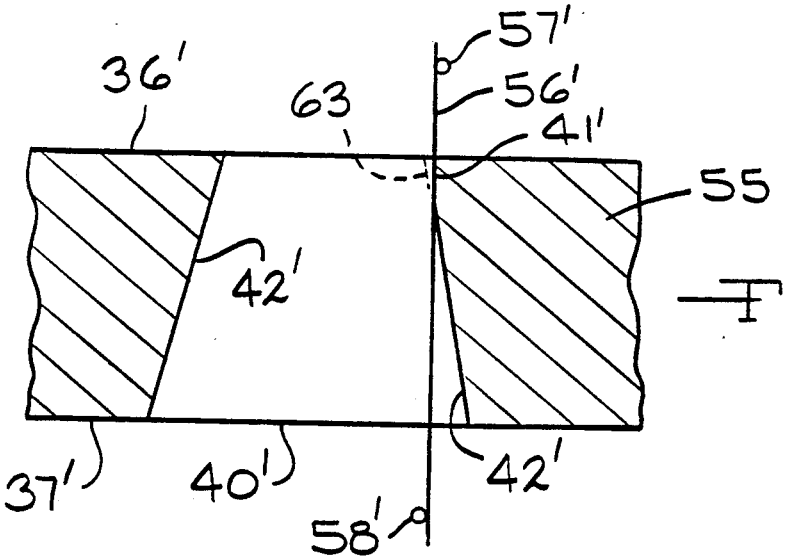
Figure 11:
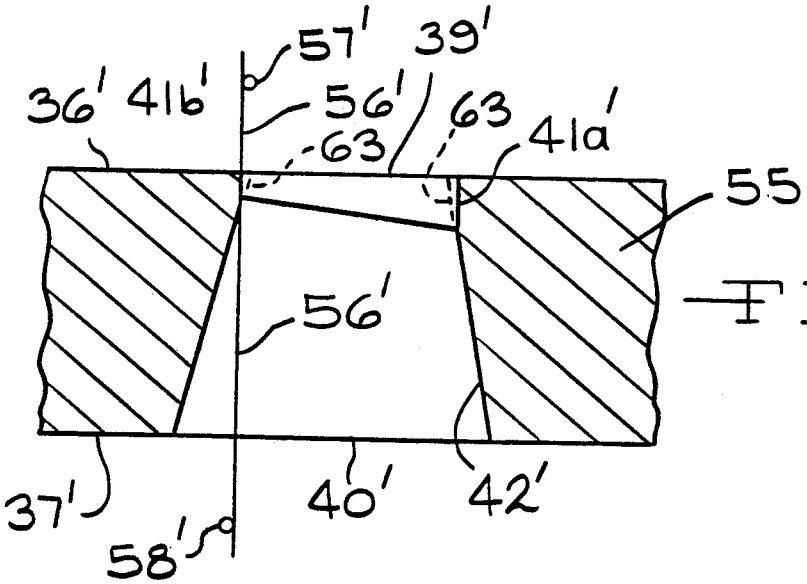

Referring now to FIGS. 9–11, the method of the present invention for forming the extrusion die 35 of FIG. 4 will be described. There is shown in FIG. 9 a workpiece or die blank 55 normally formed of hardened steel or other metal capable of withstanding the stresses resulting from extrusion. For example, standard dies for aluminum extrusion may be made from OVAR 2 MICRODIZED, hardened to 48–50 HRC nitrided/nitrocarburized by a salt bath or other treatment with the nitrited layer having a thickness on the order of 0.1 mm and a surface hardness exceeding 1000 HV. The types of metals to be used for dies are well-known in the industry and form no part of the present invention. The die blank 55 has an upper surface 36' representing the inlet side of the die to be formed and a lower surface 37' representing the outlet side of such die, which lower surface is parallel to the upper surface 36'.

As shown in FIG. 9, there is provided a wire 56 of a four-axis wire-cut electrical discharge machine. Such wire 56 is supported between an upper fulcrum 57 and a lower fulcrum 58. The upper fulcrum 57 is moveable in both X and Y directions in a plane generally parallel to the upper surface 36' of the die blank 55. The lower fulcrum 58 is capable of movement in both X' and Y' directions in a second plane generally parallel to the lower surface 37' with the movement of the lower fulcrum 58 being totally independent of the movement of the upper fulcrum 57.

In cutting the workpiece or die blank 55 to form the finished die, there are two separate cutting operations. During the first cutting operation, illustrated in FIG. 9, the wire 56 is initially disposed at an angle representing the angle of taper desired for the relief surface 42' in that area. The size of such angle may vary for different areas of relief surface 42' being formed during such cutting step. It is not necessary to compute the specific angle of taper for any particular area of the relief surface 42'. Rather, the engineer, in programming the movement of the upper fulcrum 57 and lower fulcrum 58 to form a specific configuration of die pursuant to the present invention will determine by computer or otherwise (1) the size and shape of aperture 40' for the outlet face 37', (2) the shape of the bearing surface 41', and (3) the length of bearing surface for each point around the periphery of the bearing surface 41'. As will be appreciated, in fixing the length of bearing surface for each point around the periphery of the bearing surface 41', the points of intersection of all areas of the bearing surface 41' with the relief surface 42' will be determined. Such points of intersection are illustrated by the dots designated Q in FIG. 9. The shape of such aperture 40' is designed to ensure that the metal in all areas of the die, including ones where there is little space such as in the tongue area of a U-shaped section, extends as far as possible, preferably completely to such outlet face 37'. Such first cutting operation forms the aperture 40' in the outlet face 37' which precisely conforms to the desired opening at such surface. Additionally, the cutting wire 56 through programming of movement of the upper fulcrum 57 and lower fulcrum 58 causes the wire 56 to intersect the desired bearing surface at points around the periphery spaced from the inlet face 36' by varying amounts equal to the length of the bearing surface 41' desired for that area of the die. Thus, the wire 56 is caused to cut the die blank 55 through each of th dots Q. The first cut, as illustrated in FIG. 9, in addition to forming the aperture 40 at the outlet face 37 forms an opening 70 at the inlet face 36' which is smaller than the desired inlet aperture 39' of the finished die as determined by the bearing surface 41'. This will become clearer following the description of the second cutting step.

As seen in FIGS. 10 and 11, a second wire cutting operation on the same or a different wire cutting electrical discharge machine. A wire 56' is suspended between an upper fulcrum 57' and lower fulcrum 58' and makes a second cut parallel to the direction of extrusion (i.e., perpendicular to the inlet face 36') in order to form the bearing surface 41'. This results in removal of that portion of the die blank 55 adjacent the inlet face 36' and outwardly of the opening formed in the first cut illustrated in FIG. 9. Such material being cut in the second cutting operation may be referred to as an extension 63.

During the second cutting operation as shown in FIGS. 10 and 11, the upper fulcrum 57' and the lower fulcrum 58' are positioned so that wire 56' is parallel to such desired direction of extrusion and perpendicular to the inlet face 36' at all times during cutting so that in cutting the die blank 55 and removing the extension 63 it will form all portions the bearing surface 41' parallel to each other in the direction of extrusion.

As can be seen from FIG. 11, the section of the die being shown is a portion of the die in which there is a transition from a long bearing surface 41*a*′ on the right to a shorter bearing surface 41*b*′ on the left with a transition area 41*c*′ therebetween.

Since the second cutting step is performed with the wire 56′ disposed in a position parallel to the desired direction of extrusion at all times, it is not necessary that the upper fulcrum 57′ and lower fulcrum 58′ have the capability of four-axis movement. Thus, the respective paths followed by the upper fulcrum 57′ and lower fulcrum 58′ in making the second cut to form the bearing surface 41′ are parallel to one another. Although it is clearly preferred to utilize electric discharge machining for performing the second of the two cuts, since the bearing surface is always parallel to the direction of extrusion, it is possible to utilize other cutting means for making this particular cut.

Figure 12:
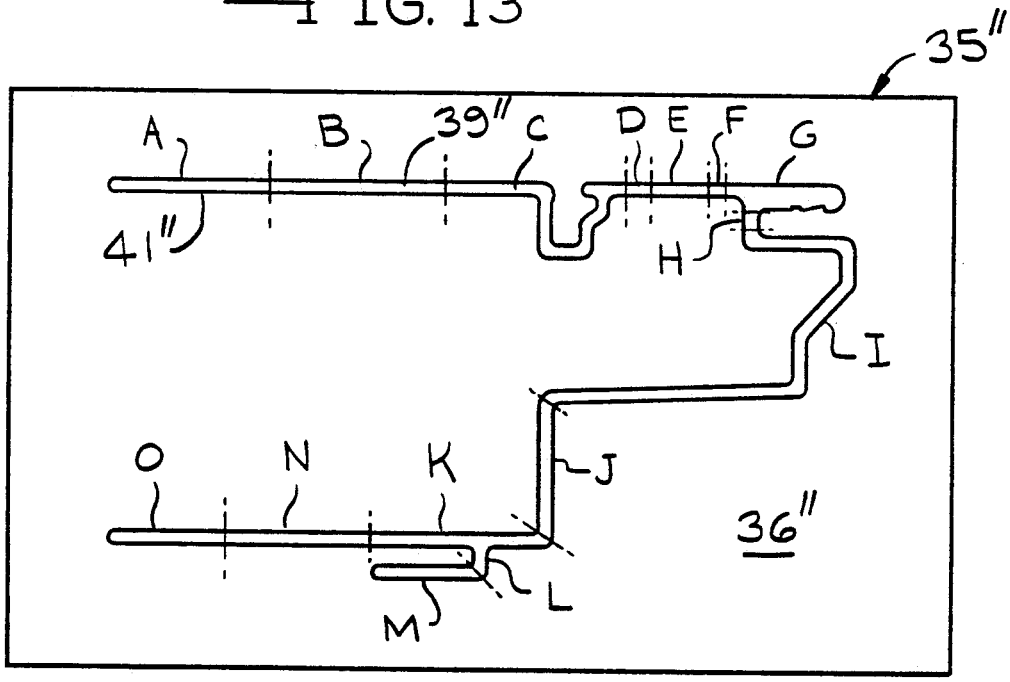
FIG. 12 is a plan view of the inlet side of a die for making an extruded article having a complex shape.

Referring now to FIG. 12, there is shown in plan view another shape of die 35″ of the present invention looking toward the inlet face 36″ and the inlet aperture 39″. It will be understood that such inlet aperture 39″ represents both the cross-sectional configuration of the article and the configuration of the bearing surface 41″ of the die, as such bearing surface 41″ determines the final cross-sectional configuration of the article being extruded.

Figure 13:
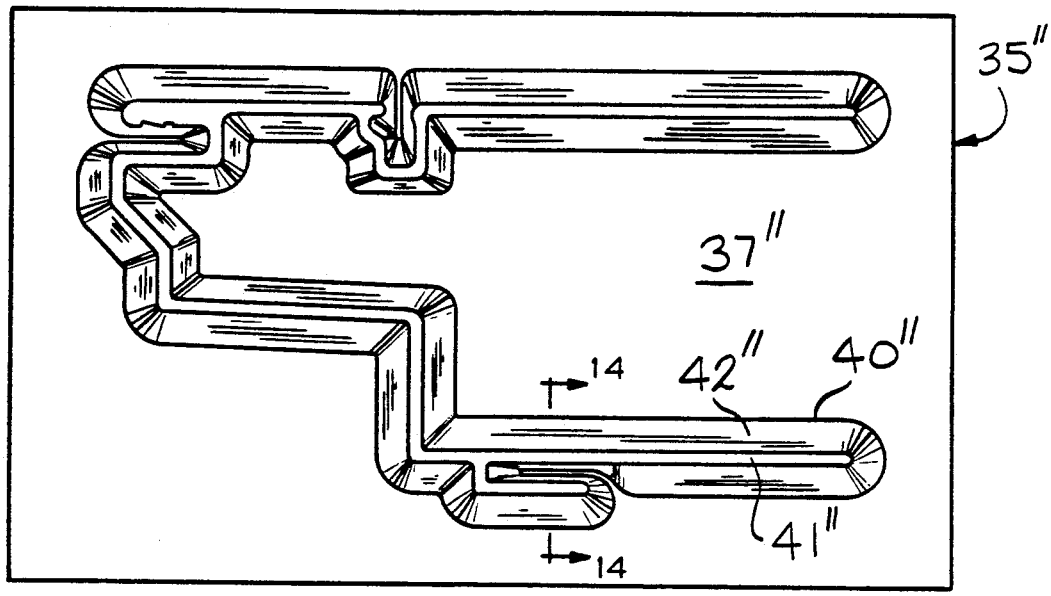
FIG. 13 is a plan view of the outlet side of such die showing the relief surfaces and their intersection with the bearing surface on the inside and intersection with the outlet side of the die on the outside periphery.

FIG. 13 is a plan view of the outlet face 37″ of the die 35″ showing the relief surfaces 42″.

In order to show the length of the bearing surface 41″ in various areas, the die will be described section by section basis. For example, the inlet opening 39″ has an end segment A of the upper leg has a thickness of 0.045 inch and the length of the bearing surface in that area is 0.035 inch. Section B also has a thickness of 0.045 inch; however, the length of the bearing surface in that area is in transition. Thus, section C which is a complex U-shape has a thickness of 0.050 inch and a bearing surface with a length of 0.050 inch. Accordingly, the length of the bearing surface in section B varies from 0.035 inch adjacent the section A to 0.050 inch adjacent section C. Section E has a thickness of 0.050 inch and a length of bearing surface of 0.080 inch with section D having varying length from 0.050 adjacent section C to 0.080 adjacent section E. Section G which has a thickness of 0.093 inch has a bearing surface with a length of 0.10 inch. Section F is a transition area between sections E and G. Section I has a thickness of 0.050 inch and a length of bearing surface of 0.080 inch with section H serving as a transition area between it and section G. Section K has a wall thickness of 0.050 inch and a length of bearing surface of 0.050 inch. Section J is a transition area with a length of bearing surface varying from 0.080 inch adjacent section I to 0.050 inch adjacent section K. Section M has a thickness of 0.050 inch and a length of bearing surface of 0.040 inch and section L is a transition area with a length of bearing surface varying between 0.050 inch and 0.040 inch. Section O has a thickness of 0.050 inch and a length of bearing surface of 0.040. Section N is a transition area having the same wall thickness of 0.050 inch as section O but having a length of bearing surface which varies from 0.050 at the end adjacent section K to 0.040 at the end adjacent section O.

Figure 14:
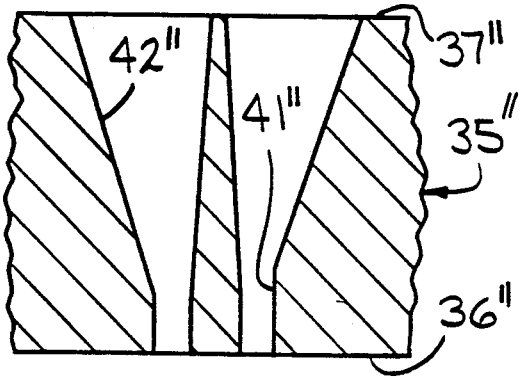
FIG. 14 is a sectional view through one area of the die taken along line 14–14 of FIG. 13.

As can be seen in FIGS. 13 and 14, the relief surface 42″ is tapered at different angles in different areas and, therefore, defines an outlet opening 40″ of varying width because of the limitations in the amount of metal available in the U-shaped areas such as that between sections M and K. Thus, as will be appreciated, the angle of taper of the relief surface 42″ will vary in those areas. This can be seen more readily in FIG. 14 which is a sectional view taken through that portion of the die used for forming such U-shaped portion.

The die of the present invention and the method of forming permit complex shapes of metal to be readily extruded at cooler temperatures than heretofore possible for such types of complex shapes with less wear on the die, and with greater economies than heretofore available. Thus, aluminum extruded from a prior art extrusion die of the type shown in FIG. 3 is extruded at a temperature of approximately 1000° F. In contrast, aluminum is extruded from the extrusion die of the present invention at temperatures in the range of 940° to 950° F. Additionally, the method of forming such dies as disclosed and claimed herein permits the dies to be manufactured more economically and accurately than heretofore possible. More importantly such method permits the forming of more complex die than was heretofore possible.

Many modifications will become readily apparent to those skilled in the art. Accordingly, the scope of this invention should be limited only by the scope of the appended claims.

I claim:

1. An extrusion die for extrusion of a metal extrudate comprising:

a planar inlet side and a planar outlet side, an inlet aperture on said inlet side, an outlet aperture on said outlet side, a passageway extending between said inlet aperture and said outlet aperture, said passageway having a bearing section and a relief section, said bearing section having a shape corresponding to the shape of the desired cross-sectional configuration of said extrudate and extending inwardly along a path parallel to the direction of extrusion from said planar inlet side at said inlet aperture to said relief section, said relief section tapering outwardly beginning directly at said bearing section in the direction of extrusion in a straight-line path, with major portions of said relief section extending to said outlet side, said outward tapering establishing an increasing cross-sectional dimension in said relief section in the direction of extrusion.

2. The extrusion die according to claim 1, wherein all portions of said relief section extend to said outlet side.

3. The extrusion die according to claim 1, wherein the length of the bearing surface from inlet aperture to said relief section is variable.

4. The extrusion die according to claim 1, wherein said relief section tapers at different angles in various areas, said angles being in the range of ¼° to 25° as measured between a line on said relief section parallel to the direction of extrusion and a line defined by an opposing edge of said extrudate being extruded.

5. An extrusion die according to claim 1, wherein the length of the bearing surface from the inlet aperture to said relief section is equal to 0.8–1.0 times the width of the inlet aperture in any portion thereof.

6. An extrusion die having an inlet aperture in a planar inlet side and communicating with a passageway through which metal is extruded in a direction away from said inlet aperture, said passageway extending to an outlet aperture lying in a planar outlet side parallel to said inlet side, said die comprising:

(a) a bearing surface commencing at said planar inlet side in said inlet aperture and extending inwardly perpendicular to and at said planar inlet side; and, (b) a negatively tapered relief surface extending along a straight-line path, beginning directly at said bearing surface, the angle of taper of said negatively tapered relief surface being in the range of ¼° to 25°, said negative taper establishing an increasing cross-sectional dimension in said relief section in the direction of extrusion.

7. The extrusion die according to claim 6, wherein all portions of said relief surface extend to said outlet side.

8. The extrusion die according to claim 6, wherein the length of the bearing surface from said inlet aperture to said relief surface is variable.

9. The extrusion die according to claim 6, wherein said relief section tapers at different angles in various areas.

10. An extrusion die for extrusion of a metal extrudate comprising:

a planar inlet side and a planar outlet side, an inlet aperture on said inlet side, an outlet aperture on said outlet side, a passageway extending between said inlet aperture and said outlet aperture, said passageway having a bearing section and a relief section, said bearing section having a shape corresponding to the shape of the desired cross-sectional configuration of said extrudate and extending inwardly from said inlet aperture along a path parallel to the direction of extrusion, the length of the bearing surface from inlet aperture to said relief section being variable, said relief section tapering outwardly in the direction of extrusion in a straight-line path beginning at said bearing section at different angles in various areas, said angles being in the range of ¼° to 25° as measured between a line on said relief section parallel to the direction of extrusion and a line defined by an opposing edge of said extrudate being extruded.

11. An extrusion die having an inlet aperture in a planar inlet side and communicating with a passageway through which metal is extruded in a direction away from said inlet aperture, said passageway extending to an outlet aperture lying in a planar outlet side parallel to said inlet side, said die comprising:

(a) a bearing surface commencing at said planar inlet side in said inlet aperture and extending inwardly perpendicular to and at said planar inlet side, the length of said bearing surface inwardly from said inlet aperture being variable; and (b) a negatively tapered relief surface extending along a straight-line path directly from said bearing surface toward said outlet side, the angle of taper of said negatively tapered relief surface being in the range of ¼° to 25°, some areas of said relief surface tapering at different angles than other areas, said negative taper establishing an increasing cross-sectional dimension in said relief section in the direction of extrusion.

12. A die for extrusion of a metal extrudate having a predetermined cross-sectional shape, said die comprising a planar inlet face, a planar outlet face spaced from and parallel to said inlet face, a passageway extending from said inlet face to said outlet face, said passageway defined by (1) a bearing surface extending inwardly from said inlet face toward said outlet face, all portions of said bearing surface being perpendicular to said inlet face, said bearing surface defining an opening conforming to the desired cross-sectional shape of said extrudate and (2) a relief surface extending downstream from and outwardly from those portions of said bearing surface spaced the furthest from said inlet face, all portions of said relief surface extending along a straight path beginning directly at said bearing surface and tapering outwardly in the direction of extrusion, said outward tapering establishing an increasing cross-sectional dimension in said relief section in the direction of extrusion.

13. A die for extrusion of a metal extrudate according to claim 12, wherein all portions of said relief surface extend to said outlet face.

14. A die for extrusion of a metal extrudate according to claim 12, wherein all said portions of the relief surface taper outwardly from said bearing surface at angles in the range of ¼° to 25° as measured between said relief surface and a line formed as an extension of the aligned portion of said bearing surface.

15. A die for extrusion of a metal extrudate according to claim 12, wherein the length of the bearing surface varies in various portions and at any area around said opening is 0.8 to 1.0 times the size of said opening in that area.

16. A method for extruding a metal comprising the steps of providing an extrusion die having a planar inlet side and a planar outlet side, an inlet aperture on said inlet side, an outlet aperture on said outlet side, a passageway extending between said inlet aperture and said outlet aperture for forcing the metal in a given direction therethrough, said passageway having a bearing section and a relief section, said bearing section having a shape corresponding to the shape of the desired cross-sectional configuration of said extrudate and extending inwardly from said planar inlet side at said inlet aperture along a path parallel to the direction of extrusion, said relief section tapering outwardly in the direction of extrusion in a straight-line path beginning directly at said bearing section, with major portions of said relief section extending to said outlet side, said outward tapering establishing an increasing cross-sectional dimension in said relief section in the direction of extrusion, and forcing the metal through said passageway so that the metal immediately passes into said bearing section after passing through said planar inlet side and immediately passes into said relief section after passing through said bearing section.

* * * * *